United States Patent [19]

Simm et al.

[11] Patent Number: 5,005,764

[45] Date of Patent: Apr. 9, 1991

[54] APPARATUS FOR FLAME SPRAYING OF POWDER MATERIALS

[75] Inventors: Wolfgang Simm, Ecublens; Hans-Theo Steine, Cugy, both of Switzerland; Karl P. Streb, Markt-Mömbris, Fed. Rep. of Germany

[73] Assignee: Castolin S.A., Sulpice, Switzerland

[21] Appl. No.: 477,629

[22] Filed: Feb. 9, 1990

[30] Foreign Application Priority Data

Feb. 10, 1989 [DE] Fed. Rep. of Germany ..... 3903888

[51] Int. Cl.[5] ..... B05B 7/20; B05B 15/08; C23C 4/00

[52] U.S. Cl. ..... 239/79; 239/132.3; 219/76.16; 219/121.47

[58] Field of Search ..... 239/79, 81, 85, 132.3; 219/76.15, 76.16, 121.47

[56] References Cited

U.S. PATENT DOCUMENTS 2,861,900 11/1958 Smith et al. ..... 239/79 X
3,055,591 9/1962 Shepard ..... 219/121.47 X
4,231,518 11/1980 Zverev et al. ..... 239/85 X
4,694,990 9/1987 Karlsson et al. ..... 239/81
4,869,936 9/1989 Moskowitz et al. ..... 239/79 X

*Primary Examiner*—Andres Kashnikow
*Assistant Examiner*—William Grant
*Attorney, Agent, or Firm*—Bachman & LaPointe

[57] ABSTRACT

An apparatus for flame spraying, in particular of powder material by means of an autogenous flame, comprising a nozzle carrier which has a burner nozzle and which can be connected to a preferably tubular accelerating accessory device which is provided with coolant guide means surrounding the burner nozzle, is improved in that the accelerating accessory device (40) bears slidably against a central arm (12) of the nozzle carrier (10) with an axial portion (45), a conical region (44) adjoins the axial portion (45) at a position remote from the nozzle, and a portion (42) which outwardly embraces a combustion chamber (50) adjoins the conical region (44), wherein the combustion chamber is delimited towards the burner by a movable annular body (38). In addition the burner nozzle (9) is to be disposed approximately in one plane with flame outlet openings of the accelerating accessory device (40) and is adapted to be retracted and extended.

23 Claims, 2 Drawing Sheets

APPARATUS FOR FLAME SPRAYING OF POWDER MATERIALS

BACKGROUND OF THE INVENTION

This invention relates to an apparatus for flame spraying, in particular of powder materials by means of an autogenous flame, comprising a nozzle carrier which has a burner nozzle and which can be connected to a preferably tubular accelerating accessory device which is provided with coolant guide means surrounding the burner nozzle.

Flame spraying apparatuses with accessory devices for post-acceleration of the flame are known. A problem which consistently occurs in relation to such flame spraying apparatuses is reliable ignition and adjustment of the flame. Various procedures have been developed for that purpose, for example igniting the flame by means of a sparking plug or an igniter device; that kind of construction suffers from the risk of explosion as the volume of gas in the accelerating tube is relatively great. Another design configuration involves pivoting the accelerating tube away, with the flame being ignited with the tube in the pivoted-away condition. A problem with that arrangement is that, when the accelerating tube is pivoted back into position over the flame, disturbances can occur in the flame, resulting in irregularity of the flame.

The above-described measures did not provide the improvement which had been hope for, in regard to reliability and safety of flame spraying appartuses. Furthermore, adjustment of the flame to provide a normal, an oxidising or a reducing flame, is only limitedly possible.

A further problem with the known accelerating accessory devices is the fact that they cannot be adequately tuned or matched to the powder spray material to be used.

In view of those considerations, the inventor set himself the aim of eliminating the above-indicated deficiencies on an improved apparatus of the kind set forth hereinabove.

SUMMARY OF THE INVENTION

The foregoing object is attained in that the accelerating accessory device bears slidably against a central arm of the nozzle carrier with an axial portion, a conical region adjoins the axial portion at a position remote from the nozzle, and a portion which outwardly embraces a combustion chamber adjoins said conical portion, wherein the combustion chamber is delimited towards the burner by a movable annular body.

The inventor therefore found that it is possible to eliminate the deficiencies observed by a structural step; the accelerating accessory device is integrated into the flame spraying apparatus or is fitted on to same and is extended pneumatically, hydraulically or mechanically to the length of the combustion chamber which is desired or which is dependent on the powder material. The operation for igniting the flame and adjustment of the flame are effected when the accelerating accessory device is not in an entended condition.

The accelerating accessory device can be extended in accordance with the invention in different ways, for example by way of a mechanical device.

In accordance with the invention the accelerating accessory device is in the form of a double casing means with a continuous internal space for the coolant, and advantageously has a casing means which is disposed at a radial spacing around the central arm and which is provided with an end abutment to provide an end or limit position of the accelerating accessory device.

Preferably, in one embodiment the casing means is adapted to be variable in length; it is formed by a tubular portion of the nozzle carrier, on to which is screwed an abutment sleeve which has a collar-like abutment.

The above-mentioned annular body which represents a piston is movable in an annular space in the nozzle carrier and can be subjected to the effect of a fluid medium at the burner end. The fluid medium is introduced into a pressure chamber which is delimited by the annular body with an abutment face and the casing means on the one hand and the central arm on the other hand.

In that case the fluid medium in the form of compressed air is also used as a coolant, for which purpose the interior of the double casing means is on the one hand communicated with the pressure chamber and on the other hand is provided with outlets for the fluid medium.

However it is also in accordance with the invention for the casing means to be in the form of a sleeve and to be fixed variably in respect of its axial position, for example by means of a screwthread, on the nozzle carrier. In that case the double casing of the accelerating accessory device is closed towards the burner by an annular collar. At the other end the double casing means can also be closed, and is then provided in the form of a through-flow means for coolant water with feed and discharge connections, or the double casing means may be provided with bores for the discharge of fluid medium.

In accordance with the invention the accelerating accessory device may be provided with a hydraulic or pneumatic adjusting means which has at least one pressure cylinder for extension of the accelerating accessory device.

Preferably the abutment for adjustment of the combustion chamber length is arranged on a displaceably disposed locking means of the adjusting means, and the extension length of the accelerating accessory device and therewith the length of the combustion chamber can be regulated by way of an adjustable abutment.

The accelerating accessory device consisting of a combustion chamber and a cooled constricting tube is not extended prior to ignition of the flame. In accordance with the invention the burner nozzle is disposed in one plane with the flame outlet opening of the accelerating accessory device and is extended after the ignition operation. The nozzle carrier itself or a sliding surface provided thereon is used as the plane to provide for the sliding movement.

BRIEF DESCRIPTION OF THE DRAWINGS

Further advantages, features and details of the invention will be apparent from the following description of preferred embodiments and with reference to the drawings which are diagrammatic views in longitudinal section and in which.

DETAILED DESCRIPTION

Figure 1:
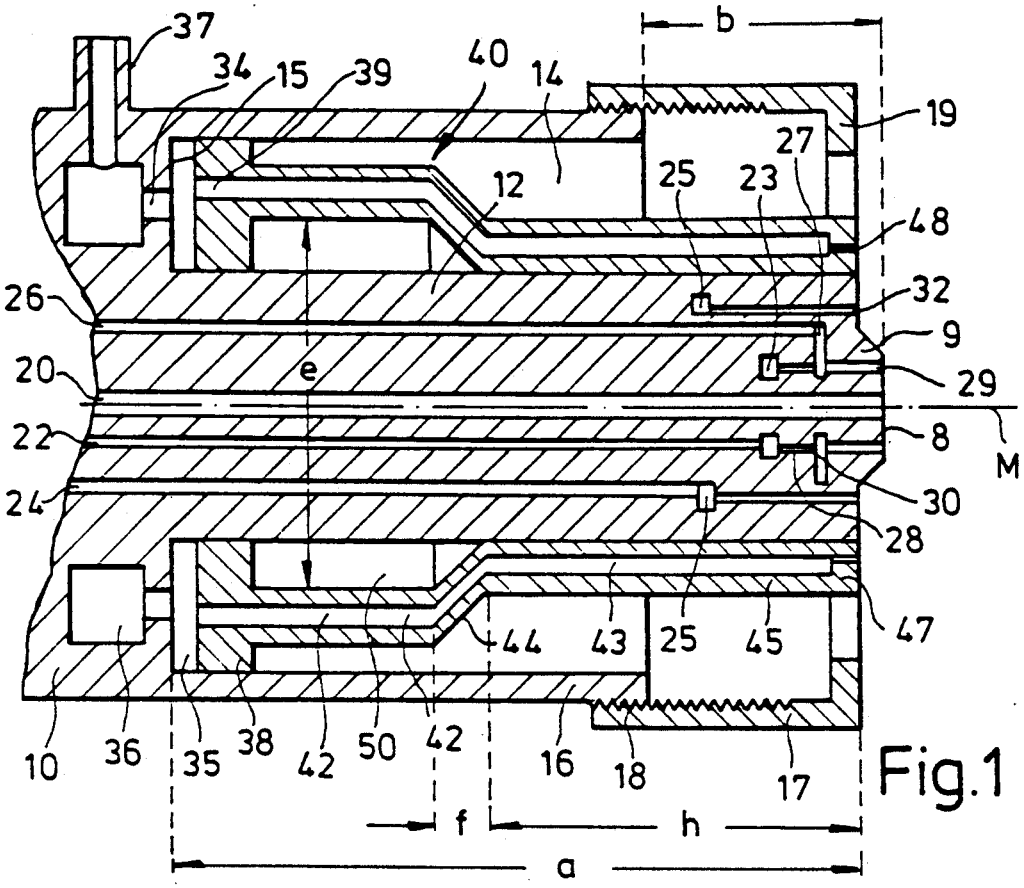
FIG. 1 shows a nozzle carrier with integrated accelerating accessory device, pneumatic extension means and adjustable combustion chamber.

As shown in FIG. 1, a nozzle carrier 10 of a burner system (not shown in further detail herein for the sake of clarity) is provided at the free end with a pole-like central arm 12 of length a and a burner nozzle 9, and is surrounded by a tubular portion or peripheral wall portion 16 of a length which is substantially equal to a-b forming an annular space or chamber 14. A screw-on tube portion having a radially directed annular abutment 19 at its other end. Extending along the longitudinal axis M of the nozzle carrier 10 is a passage 20 for carrier gas and powder guided in the flow direction. The passage 20 opens at the end 8 of the burner nozzle 9.

Disposed in parallel-axis relationship therewith are longitudinal bores 22 for oxidation gas, 24 for constricting gas and 26 for combustion gas, while annular passages 23, 25 and 27 respectively are associated with the longitudinal bores 22, 24 and 26, adjacent the end 8 of the nozzle.

The annular passage 23 for oxidation gas is communicated with the annular passage 27 of the bore 26 for combustion gas, at 28, so that a combustion gas mixture is formed upstream of a mouth opening 29.

An injector for the combustion gas/oxidation gas mixture can be seen at the annular passage 27 at the location indicated at 30, while outside the annular passage 27 mouth conduits 32 go from the constricting gas annular passage 25 to the end of the central arm 12.

Provided at a radial abutment surface 15 at the end of the annular space 14 are communicating bores 34 which communicate with an annular chamber 36 to which compressed air is supplied by way of a connection 37. Mounted opposite to the annular surface 15 in the annular space 14 is an annular piston 38 which is part of an accelerating accessory device 40. The latter comprises a double-casing tube 42 with internal space 43, makes the transition into a conically tapering region 44 of a length f, in order then to come to lie against the outside circumference of the central arm 12, more particularly in the form of a portion 45 of a length h. Towards the free end the portion 45 of the accelerating accessory device 40 is closed by a ring 47 with narrow bores 48. Portion 42 has a radial dimension Y and portion 45 has a radial dimension X when taken from the longitudinal axis m.

The portion 42 of the accelerating accessory device 40, which adjoins the annular piston 38, embraces a combustion chamber 50 having diameter e which is variable upon displacement of the accelerating accessory device 40.

The stroke movement thereof, which is defined by the above-described annular abutment 19 and which is variable by way of the screw-on tube portion 17, is controlled by means of compressed air which passes out of the annular chamber 36 through the communicating bores 34 into a pressure chamber 35 delimited by the annular piston 38. From the pressure chamber 35 the compressed air can pass through passage openings 39 in the annular piston 38 into the double casing configuration and from there axially outwardly through the bores 48.

Figure 2:
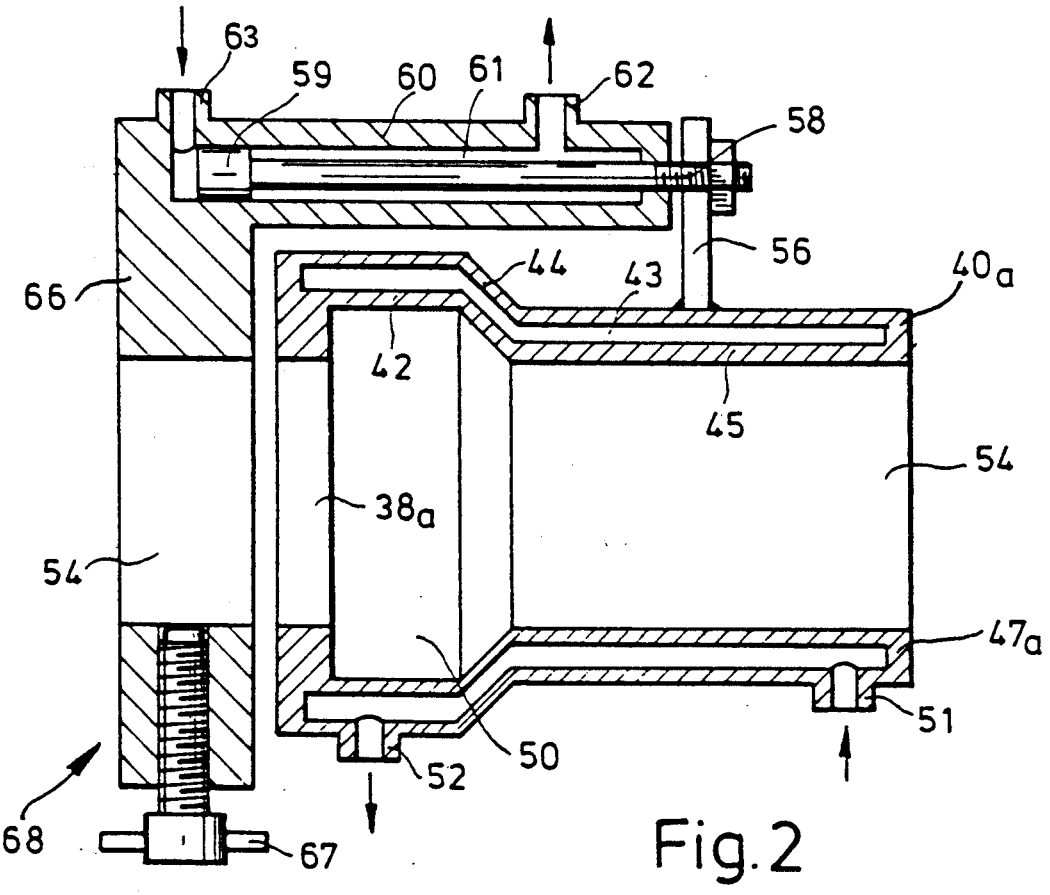
FIG. 2 shows an extension means for an acceleration tube, which can be fitted to the apparatus, for produce pneumatic extension.

In the embodiment of the accelerating accessory device $40_a$ as shown in FIG. 2, the internal space 43 is closed at one end by a ring $47_a$ and at the other end by an annular collar or flange $38_a$, and is provided with water supply connection 51 and water discharge connection 52. The nozzle carrier 10 is not illustrated herein, and the space for the sliding movement of the central arm 12 is indicated at 54.

Projecting radially from the above-described accelerating accessory device $40_a$ is a connecting bar 56 which is connected to a piston rod 58 which extends in parallel-axis relationship. The piston 59 on the piston rod 58 is slidable in a cylinder 60, the internal space 61 of which is connected to air connections 62 and 63.

The cylinder 60 is connected to a holding ring 66 which with a radial screw 67 forms a clamping means 68; by virtue thereof, the accelerating accessory device 40 can be secured to the burner or the nozzle carrier 10.

Figure 3:
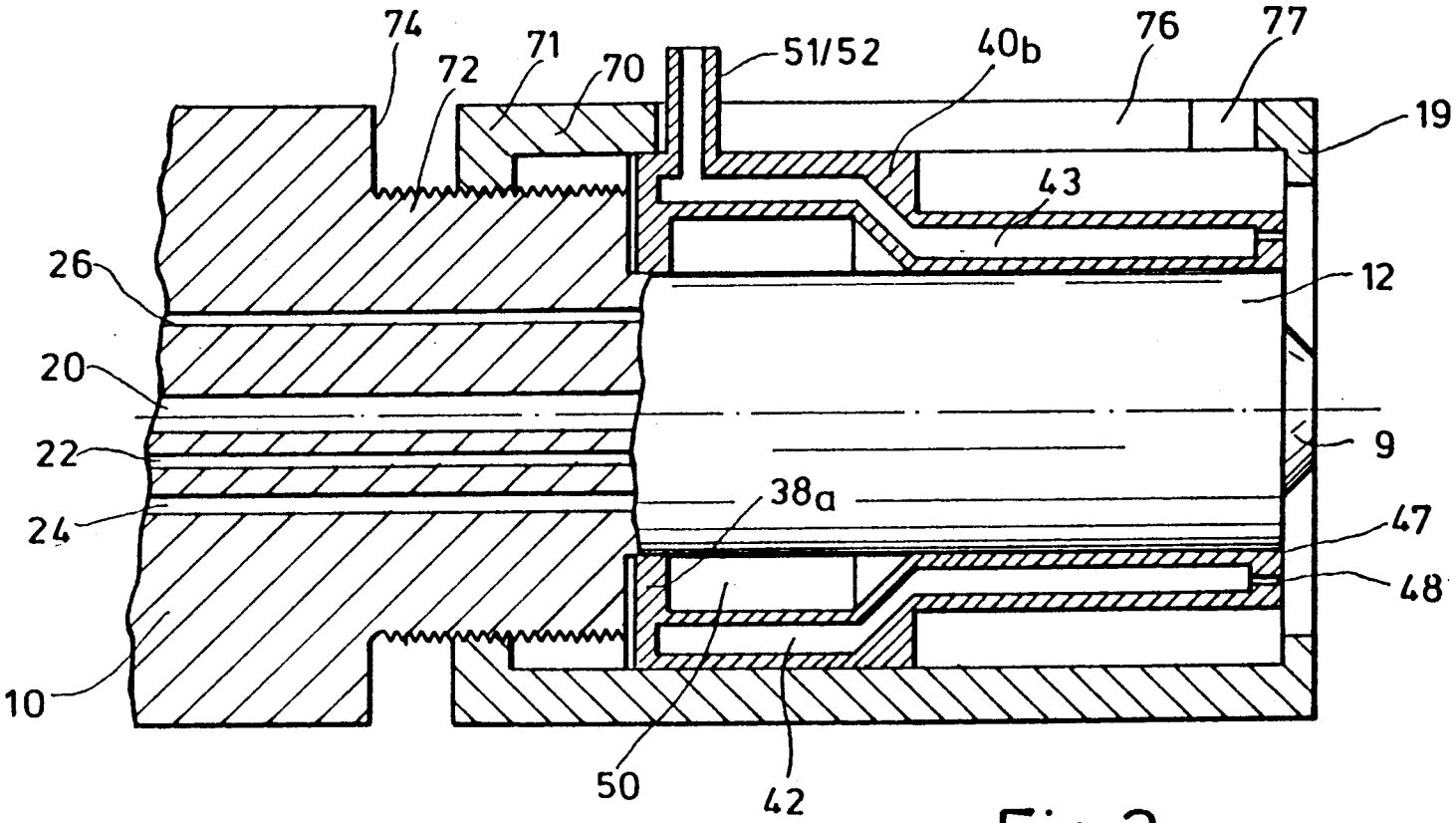
FIG. 3 shows an adjustable mechanical extension means for an acceleration tube.

In FIG. 3 the central arm 12 of the nozzle carrier 10 is not surrounded by a tube portion 16; in this case, a screw sleeve 70 with an abutment ring 71 is screwed to a male screwthread 72 on the nozzle carrier 10. The male screwthread 72 is disposed in a part of the nozzle carrier 10 which is reduced in a step configuration at 74, the crosssection thereof therefore being reduced on the one hand at 74 and on the other hand to form the central arm 12 at 75.

In this embodiment, carried on the central arm 12 is an accelerating accessory device $40_d$, the internal space 43 of which can be connected to a cooling system by at least one connection 51/52. The connection 51/52 is guided axially in a slot 76 in the screw sleeve 70. Indicated at the end of the slot 76 which is towards the end of the screw sleeve is a transverse arm 77 in which the connection 51/52 can be inserted for locking purposes. That bayonet-type connection may also be of a different configuration.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. An apparatus for flame spraying powder materials comprising a nozzle carrier having a central arm portion disposed along a longitudinal axis and a peripheral wall portion spaced from said central arm portion and disposed along said longitudinal axis thereby defining with said central arm portion an elongated annular chamber; a burner nozzle formed on one end of said central arm portion; a hollow, elongated accelerating means disposed within said annular chamber between said peripheral wall portion and said central arm portion; and means for axially moving said accelerating means between a first non-working position and a second working position wherein said accelerating means defines a combustion chamber into which said burner nozzle projects.

2. An apparatus according to claim 1 wherein said hollow, elongated accelerating means includes an internal peripheral surface comprising a first elongated surface having a radial dimension X taken from said longitudinal axis, a second elongated surface having a radial dimension Y taken from said longitudinal axis and a conical portion forming a transition between said first surface and said second surface wherein $Y > X$.

3. An apparatus according to claim 2 wherein said second elongated surface defines said combustion chamber and said first elongated surface an accelerating tube when said accelerating means is in said second working position.

4. An apparatus according to claim 2 wherein said accelerating means comprises a piston portion positioned on the free end of said second elongated surface and sealingly disposed in said annular chamber between said peripheral wall portion and said central arm portion.

5. An apparatus according to claim 4 wherein said means for axially moving includes means for applying a force to said piston portion.

6. An apparatus according to claim 2 wherein said accelerating means comprises a double walled configuration which defines an annular internal space for receiving coolant.

7. An apparatus according to claim 4 wherein said peripheral wall portion includes an end abutment upon which the piston portion of said accelerating means abuts.

8. An apparatus according to claim 4 including means for varying the length of the peripheral wall portion.

9. An apparatus according to claim 8 wherein said means for varying the length comprises the peripheral wall portion including a tubular portion having an abutment sleeve threaded thereon for adjusting the length.

10. An apparatus according to claim 2 wherein said nozzle carrier further includes an annular wall connecting said peripheral wall portion and said central arm portion and defines therewith and with said piston portion a variable volume pressure chamber.

11. An apparatus according to claim 10 wherein a source of pressurized fluid medium communicates with said variable volume pressure chamber.

12. An apparatus according to claim 11 wherein said annular wall is provided with aperture means for feeding fluid to said variable volume pressure chamber.

13. An apparatus according to claim 12 wherein a fixed pressure chamber is located upstream of said aperture means.

14. An apparatus according to claim 13 wherein said accelerating means comprises a double walled configuration which defines an annular internal space for receiving coolant.

15. An apparatus according to claim 14 wherein said annular internal space is in fluid communication with said variable volume pressure chamber.

16. An apparatus according to claim 1 wherein said peripheral wall portion is movably mounted on said nozzle carrier along said longitudinal axis.

17. An apparatus according to claim 16 wherein said peripheral wall is provided with a longitudinal slot which receives a radial element on said accelerating means for guiding same.

18. An apparatus according to claim 17 wherein said longitudinal slot is provided with a transverse slot for securing said radial element.

19. An apparatus according to claim 18 wherein said accelerating means comprises a double wall configuration which defines an annular internal space for receiving coolant.

20. An apparatus according to claim 19 wherein said radial element is provided with a passage which communicates with said annular internal space.

21. An apparatus according to claim 3 wherein said nozzle carrier includes means for axially moving said accelerating means.

22. An apparatus according to claim 21 wherein said means comprises a double acting piston reciprocally mounted in a cylinder, said piston being provided with a piston rod which is secured by securing means to said accelerating means.

23. An apparatus according to claim 7 wherein said end abutment is movably mounted on said peripheral wall portions for adjusting the length of the combustion chamber when said accelerating means is in said second position.

* * * * *